US008997828B2

(12) United States Patent
Melhuish et al.

(10) Patent No.: US 8,997,828 B2
(45) Date of Patent: Apr. 7, 2015

(54) SHIELD SYSTEM

(75) Inventors: Simon Melhuish, Ledbury (GB); Richard Collins, Cradley (GB); Andrew John Gardner, Newent (GB)

(73) Assignee: Galebreaker Group Ltd, Ledbury, Herefordshire (GB)

( * ) Notice: Subject to any disclaimer, the term of this patent is extended or adjusted under 35 U.S.C. 154(b) by 410 days.

(21) Appl. No.: 13/379,409

(22) PCT Filed: Jun. 11, 2010

(86) PCT No.: PCT/GB2010/050981

§ 371 (c)(1), (2), (4) Date: Jan. 30, 2012

(87) PCT Pub. No.: WO2010/149992

PCT Pub. Date: Dec. 29, 2010

(65) Prior Publication Data

US 2012/0118513 A1 May 17, 2012

(30) Foreign Application Priority Data

Jun. 22, 2009 (GB) ..... 0910724.4

(51) Int. Cl.

| | |
|---|---|
| ***A47G 5/02*** | (2006.01) |
| ***F28F 25/12*** | (2006.01) |
| ***F28B 11/00*** | (2006.01) |

(52) U.S. Cl.

CPC ..... *F28F 25/12* (2013.01); *F28B 11/00* (2013.01); *F24F 2221/52* (2013.01)

(58) Field of Classification Search

CPC ..... F28F 25/12; F28B 11/00

USPC ..... 160/243, 242, 246, 248, 249, 310, 120, 160/127

See application file for complete search history.

(56) References Cited

U.S. PATENT DOCUMENTS

| | | | | |
|---|---|---|---|---|
| 295,901 | A * | 4/1884 | Blank | 160/248 |
| 914,180 | A * | 3/1909 | Patterson | 160/244 |
| 3,211,211 | A * | 10/1965 | Youngs | 160/243 |
| 4,450,899 | A * | 5/1984 | Jakobsson et al. | 165/279 |
| 4,782,674 | A | 11/1988 | Johnson | |
| 5,159,974 | A * | 11/1992 | Victory, Jr. | 165/96 |
| 5,638,884 | A * | 6/1997 | Lin | 160/370.22 |
| 5,785,105 | A * | 7/1998 | Crider et al. | 160/243 |
| 7,779,900 | B2 * | 8/2010 | Ito et al. | 165/202 |
| 2003/0232590 | A1 * | 12/2003 | Okumura et al. | 454/121 |
| 2005/0215190 | A1 * | 9/2005 | Okumura et al. | 454/121 |
| 2005/0287943 | A1 * | 12/2005 | Tokunaga et al. | 454/143 |

FOREIGN PATENT DOCUMENTS

| | | |
|---|---|---|
| DE | 3701584 A1 | 8/1988 |
| DE | 4002571 A1 | 8/1991 |
| DE | 4340654 A1 | 6/1995 |

(Continued)

OTHER PUBLICATIONS

Machine translation of FR 2443659.*

*Primary Examiner* — Blair M Johnson
*Assistant Examiner* — Scott Denion
(74) *Attorney, Agent, or Firm* — King & Schickli, PLLC

(57) ABSTRACT

A shield system adapted for use in an air cooler structure (100). The shield system includes at least one flexible sheet (304) and at least one arrangement (106) for fixing, in use, the at least one flexible sheet to an air cooler structure.

24 Claims, 14 Drawing Sheets

(56) References Cited

FOREIGN PATENT DOCUMENTS

| | | | |
|---|---|---|---|
| FR | 2443659 | A2 | 7/1980 |
| GB | 492540 | A | 9/1938 |
| GB | 582287 | A | 11/1946 |
| GB | 616032 | A | 1/1949 |
| GB | 1436144 | A | 5/1976 |
| GB | 2086559 | A | 5/1982 |
| RU | 2355968 | C1 | 5/2009 |
| SU | 1240854 | A1 | 6/1986 |
| WO | 2005018745 | A1 | 3/2005 |

* cited by examiner

SHIELD SYSTEM

This application is the national stage of PCT/GB2010/050981, filed Jun. 11, 2010, which claims priority from Great Britain Patent Application Serial Number 0910724.4, filed Jun. 22, 2009, the disclosures of which are incorporated herein by reference.

FIELD OF THE INVENTION

The present invention relates to a shield system.

BACKGROUND OF THE INVENTION

Cross winds combined with certain temperatures are known to lower fan performance and have a detrimental impact on the efficiency of air coolers (AC). This type of apparatus is used in various industries, including petrochemical and process industries, and can include air cooled condensers (ACC) used in power stations. The jetting of air as it passes under the air cooler windwall creates a Venturi effect, often causing the air column in the fans to stall. This problem is more prevalent with the prevailing wind and can be exacerbated by surrounding buildings, trees, tall hedges, etc.

Some shield systems, including those used in connection with ACs, utilise a roller-blind type mechanism to adjust the position of the sheet. Various types of mechanisms for holding the shield at a desired position are known, but these are often mechanically unreliable for sheets of a larger size and/or can be difficult to use.

SUMMARY OF THE INVENTION

Embodiments of the present invention are intended to address at least some of the abovementioned problems.

According to a first aspect of the present invention there is provided a shield system adapted for use in an air cooler structure, the shield system including:

at least one flexible sheet;

at least one arrangement for fixing, in use, the at least one flexible sheet to an air cooler structure.

The at least one fixing device may include a plurality of fixing members that are attached at intervals to the structure. At least part of the fixing member may extend outwardly from part of the structure. Typically, a pair of corresponding fixing members will be attached at each interval, a first one of the pair at an upper location of the structure and a second one at a lower location. Each of the fixing members may include at least one mounting for at least one elongate member. The system may further include at least one elongate member, in use, the elongate member extending in a generally vertical direction between the mountings of a said pair of vertically-spaced fixing members. In some embodiments, each of the fixing members may include first and second mountings so that, in use, a first elongate member may extend between a first set of the upper and the lower mountings of a pair of said fixing members, and a second elongate member may extend between a second set of the upper and lower mountings. The at least one flexible sheet may be positioned between the first and the second elongate members, such that the first and the second elongate members limit movement of the flexible sheet (typically in a generally horizontal plane).

The system may further include a driving device for adjusting a position of the at least one flexible sheet. The driving device may comprise an electrical motor. The driving device may be mounted on a part of the structure. The driving device may travel along with a portion of the at least one sheet in use.

The driving device may be mounted on an arrangement, e.g. a track, connected to part of the structure. The driving device may be connected to an elongate member running along at least part of a width of the at least one sheet. The driving device may wind the at least one sheet on/off of the elongate member in use.

In use, the at least one sheet may extend between a pair of vertical struts of the structure. The system may further include at least one further sheet that, in use, extends between any gaps (e.g. where the driving device is located) between the first-mentioned sheets, and/or at or adjacent an of one of the first-mentioned sheets. The at least one further sheet may be connected to the fixing members.

In some embodiments, the fixing members may be located such that the at least one sheet, when fitted to a pair of the fixing members may extend at least partially across an input air path of a fan of the air cooler structure. In this case, each of the fixing members may be elongate members that are fitted to a part of the structure either side of the air path and each of the elongate members may be curved or angled in a direction similar to that of the air path. In use, when the at least one sheet is fitted to extend between the pair of fixing members, the sheet may guide external wind along the air path towards the fan. In some embodiments there are two of the pairs of fixing members, fitted at spaced apart locations to the structure, such that the sheets extending between each pair form a conduit for external wind to flow towards the fan, which can boost performance of the fan. The fixing members may provide a rack for allowing a driving device to adjust the position of the at least one sheet.

The air cooler structure will normally be one that is at least partially exposed to environment.

The driving device may be connected to, or may include, a controller, which may have manual controls. Alternatively or additionally, the controller may receive control signals from a weather condition-monitoring device. The weather condition-monitoring device may monitor wind speed, wind direction, AC key indicators and/or temperature. The controller may be configured to position the at least one sheet in a fully-open configuration if the wind speed is within a first range. The controller may be configured to position the at least one sheet in a partially-open configuration if the wind speed is within a second range. The controller may be configured to position the at least one sheet in a fully-closed configuration if the wind speed is within a third range. The weather condition-monitoring device may also monitor temperature and/or air pressure and/or precipitation and the controller may be configured to use at least one of these readings when determining how to position the at least one sheet.

In an alternative embodiment, the at least one sheet may be provided in a Venetian blind type configuration.

The at least one fixing arrangement may include at least one clamp or the like.

The flexible sheet may comprise a mesh or a solid sheet. The mesh may be between around 5% and 50% permeable/open gauge materials. Examples of suitable mesh materials include PVC coated polyester. The flexible sheet may be coated with, or formed of, a (preferably non-toxic) material that provides rot-proof qualities, tear resistance and/or UV stability.

The system may include a catch mechanism substantially as described herein for releasably fixing a position of the at least one sheet.

According to another aspect of the present invention there is provided a method of controlling a position of a shield, which may be fitted to an AC structure, the method including:

monitoring at least one weather condition;

processing data representing the at least one weather condition, and adjusting a position of the shield in accordance with the processed data.

According to another aspect of the present invention there is provided a catch mechanism including:

a first member pivotably connected to a second member, the first member including a first portion that, in a first configuration, extends into a path of a movable device in use and is arranged such that when a lower part of the movable device strikes the first portion when travelling in a first direction, the first member is pivoted to a second configuration where it is engageable with an upper part of the movable device and prevents movement of the movable device in an opposite direction until the catch mechanism is disengaged.

The mechanism can further include a disengaging member arranged so that if the movable member is moved in the first direction after the catch mechanism has been engaged, the movable member strikes the disengaging member, which pivots the first member out of the second configuration such that the first portion is moved out of the path of the movable device, thereby allowing the movable device to be moved in the opposite direction.

The mechanism may further include a fixing device arranged to temporarily fix the first member with respect to the second member until the upper portion of the movable device has moved beyond the second portion of the first member after it has been moved out of the second configuration. The fixing device may include a magnetic arrangement. The magnetic arrangement may be mounted on the first member and engage with a metal part of the second member.

The first member may include a second portion arranged such that, when the fixing device is fixing the first member with respect of the second member, the movable device moving in the opposite direction strikes the second portion and causes the fixing device to release the first member from the second member.

The first member may be designed so that the first portion moves (e.g. under gravity) to the first configuration following release of the fixing device.

Whilst the invention has been described above, it extends to any inventive combination of features set out above or in the following description. Although illustrative embodiments of the invention are described in detail herein with reference to the accompanying drawings, it is to be understood that the invention is not limited to these precise embodiments. As such, many modifications and variations will be apparent to practitioners skilled in the art. Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

DESCRIPTION OF THE DRAWING FIGURES

The invention may be performed in various ways, and, by way of example only, embodiments thereof will now be described, reference being made to the accompanying drawings in which:

FIG. 1 shows an AC structure fitted with fixing members of an example shield system;

FIG. 2A details part of the structure and fixing members;

FIG. 2B details an alternative version of the fixing member;

FIG. 3 shows the structure fitted with further components of the shield system;

FIG. 4 details part of the shield system;

Figure 8:
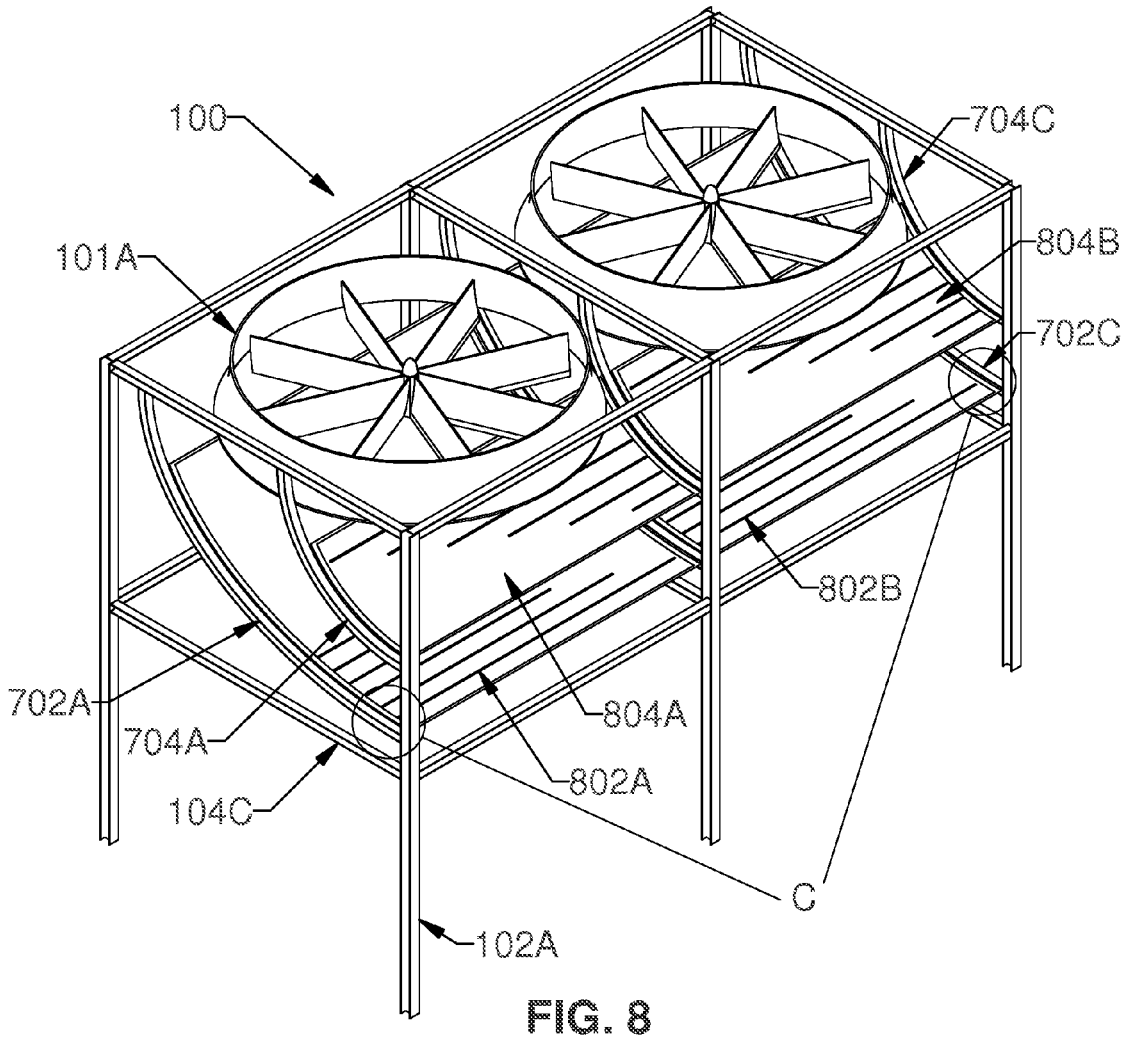
FIG. 8 shows the structure and shield system of FIG. 7 with further components fitted.
Figure 8A:
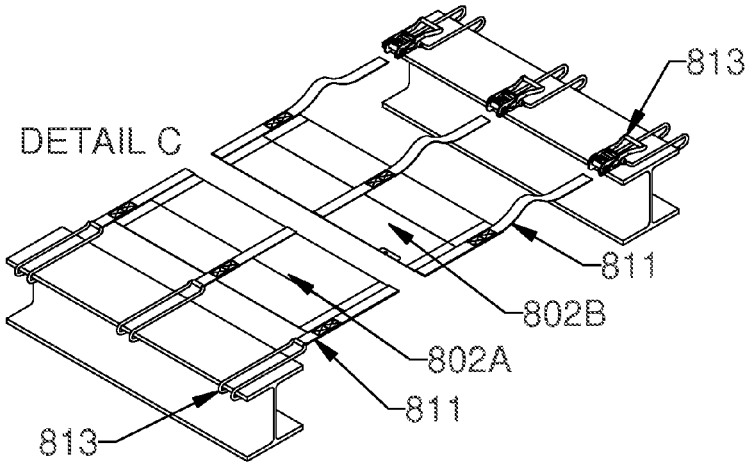
Figure 8B:
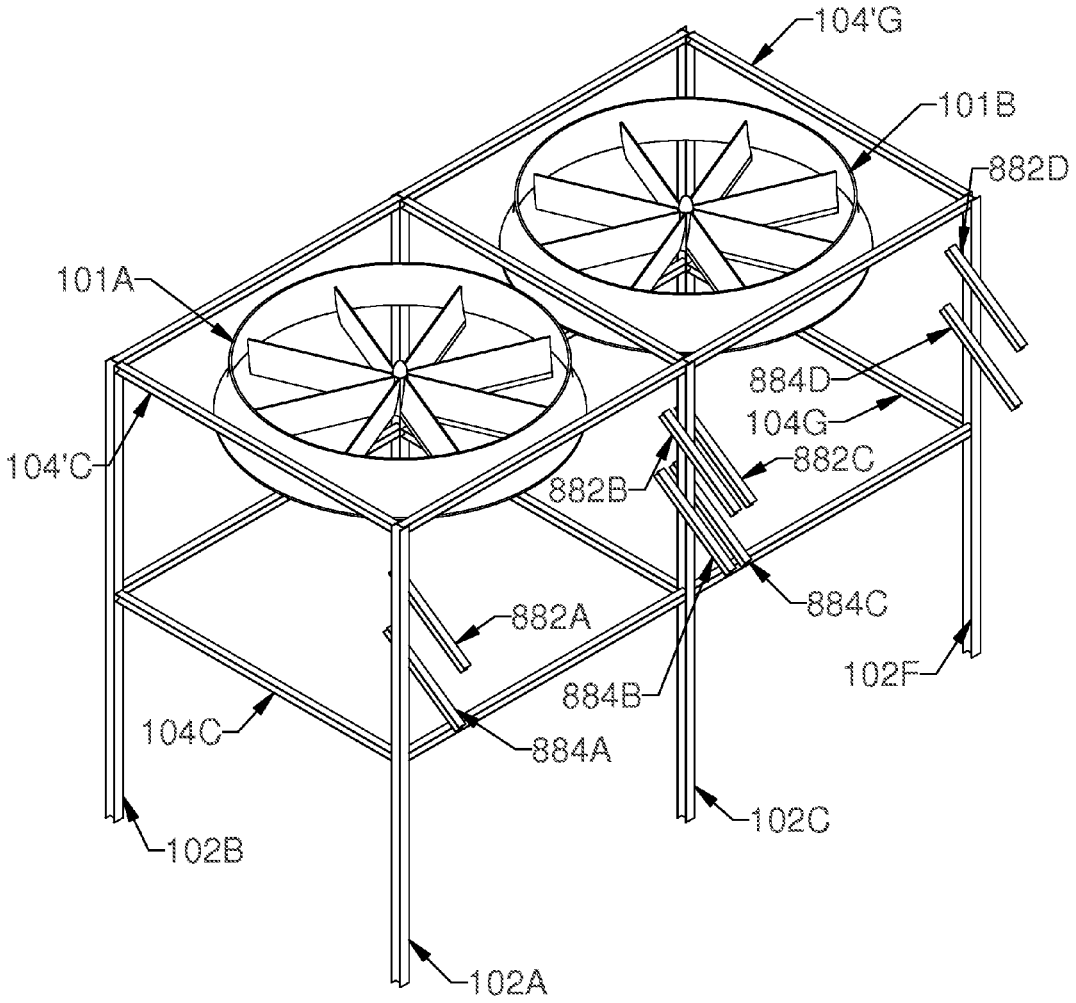
Figure 8C:
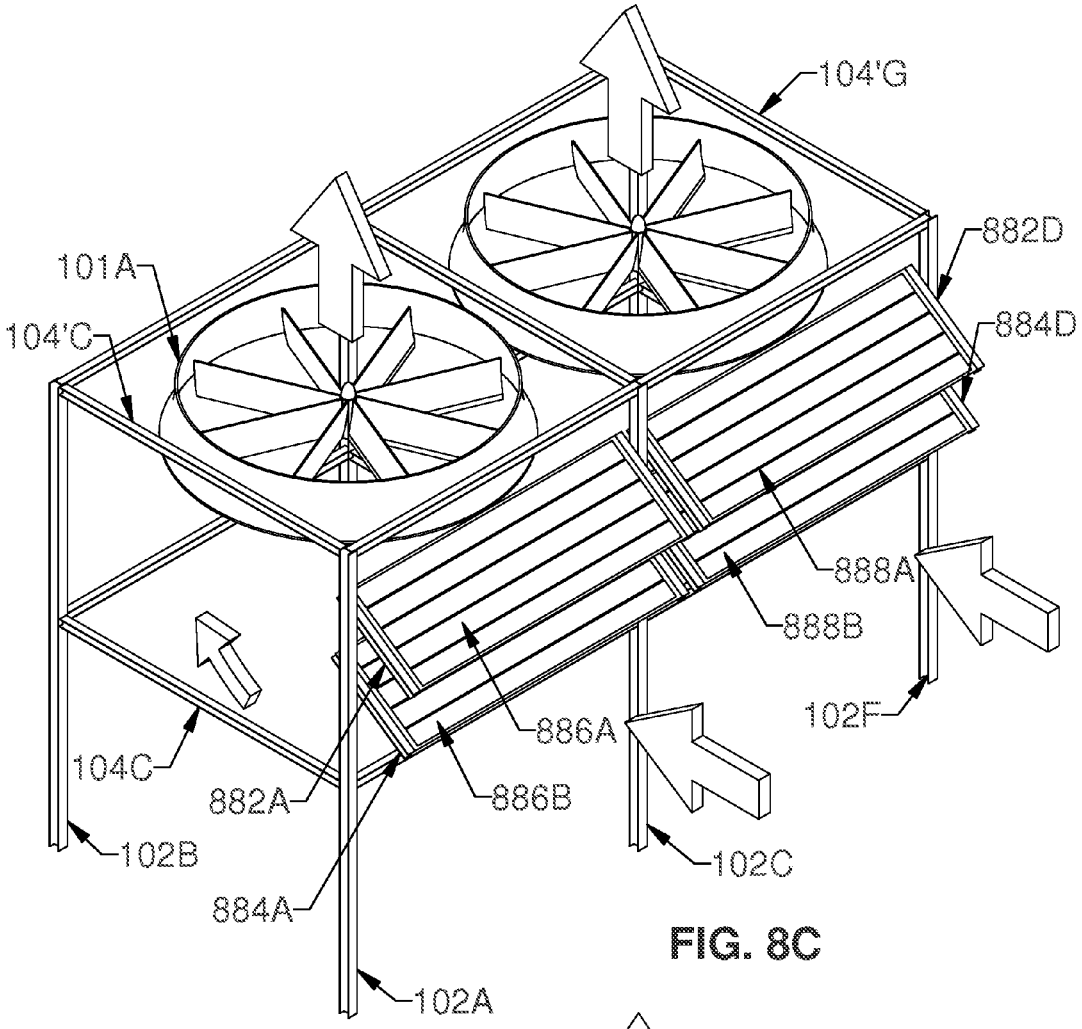
Figure 8D:
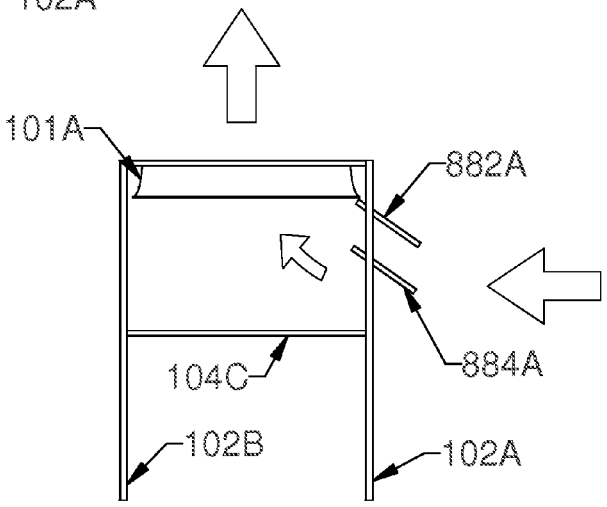
Figure 9:
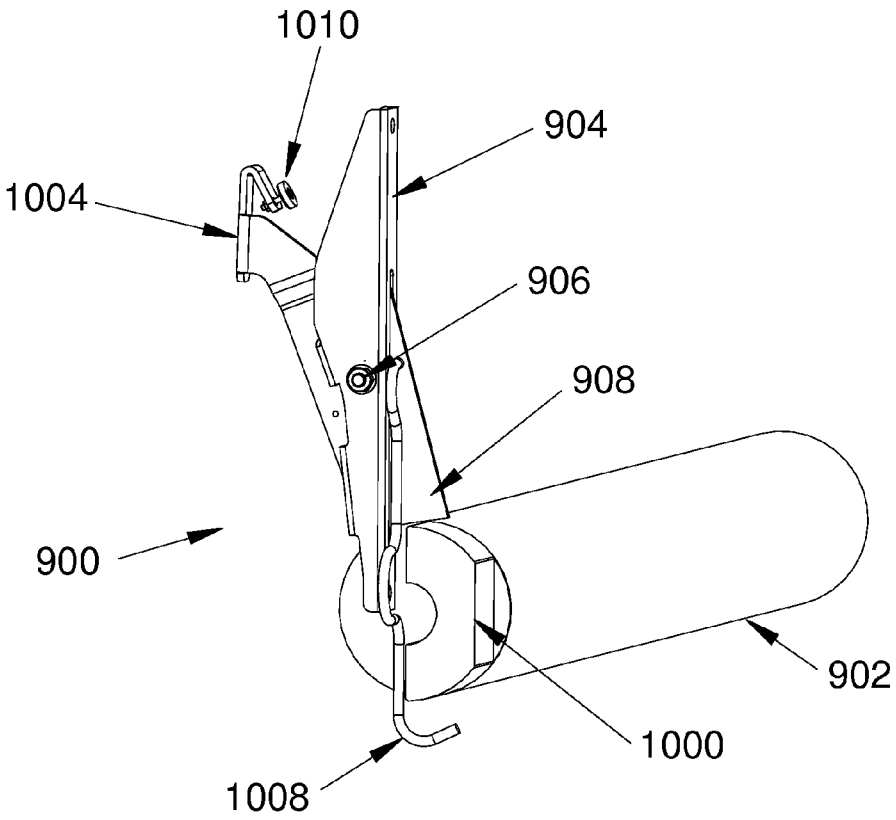

FIG. 8A details a connection of the shield system of FIG. 8 and the AC structure;

FIG. 8B shows the AC structure fitted with fixing members of yet another example shield system;

FIG. 8C shows the structure and shield system of FIG. 8B with further components fitted;

FIG. 8D is a side view of the arrangement shown in FIG. 8C;

FIG. 9 is a perspective view of a catch mechanism that can be used on the shield system;

FIGS. 10A-10F are schematic side views illustrating operation of the catch mechanism of FIG. 9, and FIGS. 11A-11F are schematic side views illustrating operation of a second example catch mechanism.

DETAILED DESCRIPTION OF THE INVENTION

Figure 1:
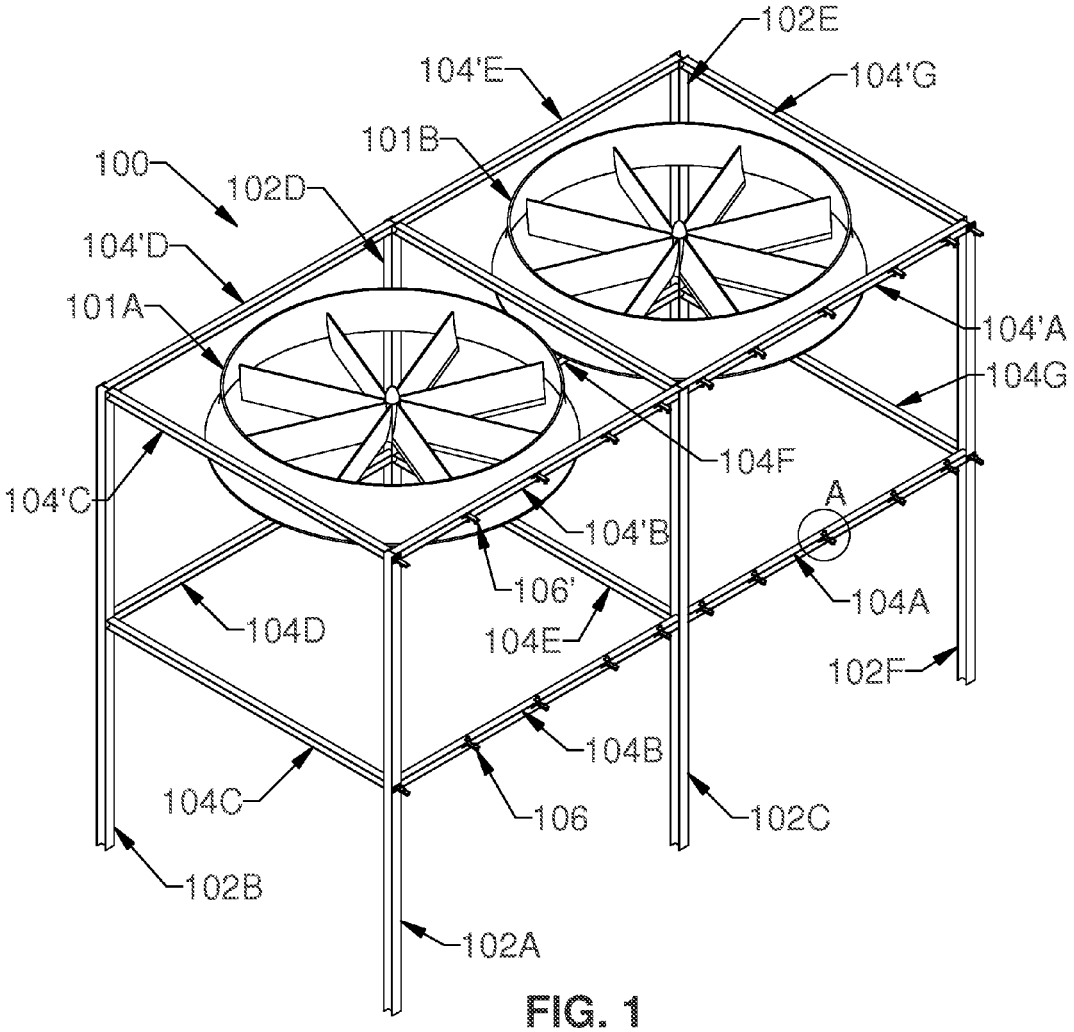

FIG. 1 is a simplified view of an AC structure 100. The only parts of the structure shown in the drawing are a pair of fans 101A, 101B and a supporting framework comprising uprights 102A-102F, lower horizontal struts 104A-104G and upper horizontal struts 104'A-104'G. It will be appreciated that various other components of the AC are not shown for ease of illustration. It will also be understood that the configuration of fans and framework shown in the drawing are exemplary only and many variations are possible, e.g. there may be a different number/arrangement of fans and they may be supported by a different type of structure.

Figure 2A:
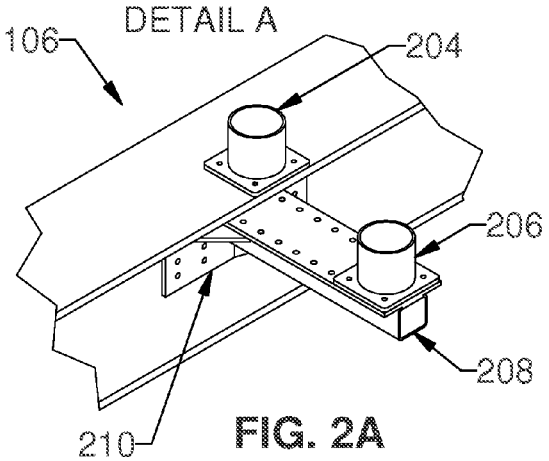

In the example two of the lower horizontal struts 104A, 104B are fitted with fixing members 106 that are part of an example shield system. The fixing members are shown in more detail in FIG. 2A. As can be seen, each fixing member comprises an inner mount 204 that is formed of a cylindrical component with an open upper end that is fixed to a square plate. The plate is fixed, e.g. by rivets, to an upper surface of one of the struts 104A, 104B. The fixing member also includes an outer mount 206 that comprises a similar cylindrical component with an open upper end that is fixed to the upper surface of an elongate member 208 that projects perpendicularly from the strut 104. The elongate member can be fixed to the strut by means of a riveted bracket 210.

Figure 2B:
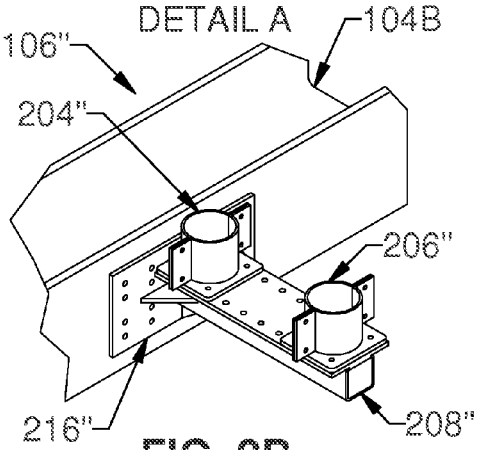

FIG. 2B shows an alternative version of the fixing member 106" having a cylindrical mount 204" fixed to an end of the elongate member 208" adjacent where it is connected (by means of plate 210") to the strut 104B. Each of the cylindrical members 204", 208" include a pair of diametrically-opposed wings.

It will be understood that the design and arrangement of the fixing members shown are exemplary only and that many variations are possible. For instance, the cylindrical mounts 204, 206 are designed to receive poles of circular cross-section (as will be described below) but can be of any shape appropriate to receive a member of alternative design. The fixing members in the example can be formed of steel, but it will be appreciated that other materials, and other attachment methods can be used.

There is also a second set of fixing members 106' attached at intervals along two of the upper struts 104'A, 104'B, the locations corresponding to the locations of the lower fixing members 106 on the lower horizontal struts 104A, 104B. The upper fixing members will normally be identical to the lower fixing members 106, but fixed to the upper struts in an upside-down configuration. It will be understood that the number, design and arrangement of the fixing members shown in the drawings are exemplary only. The shield system in the example is being fitted to one side of the AC structure. This may or may not be the side of the structure that is exposed to the prevailing wind and in some cases, shield systems may be attached to more than one part/side of the structure. The system can conveniently be fixed to existing structures, with or without the need to modify the structure, or may be integrated into a structure during manufacture.

Figure 3:
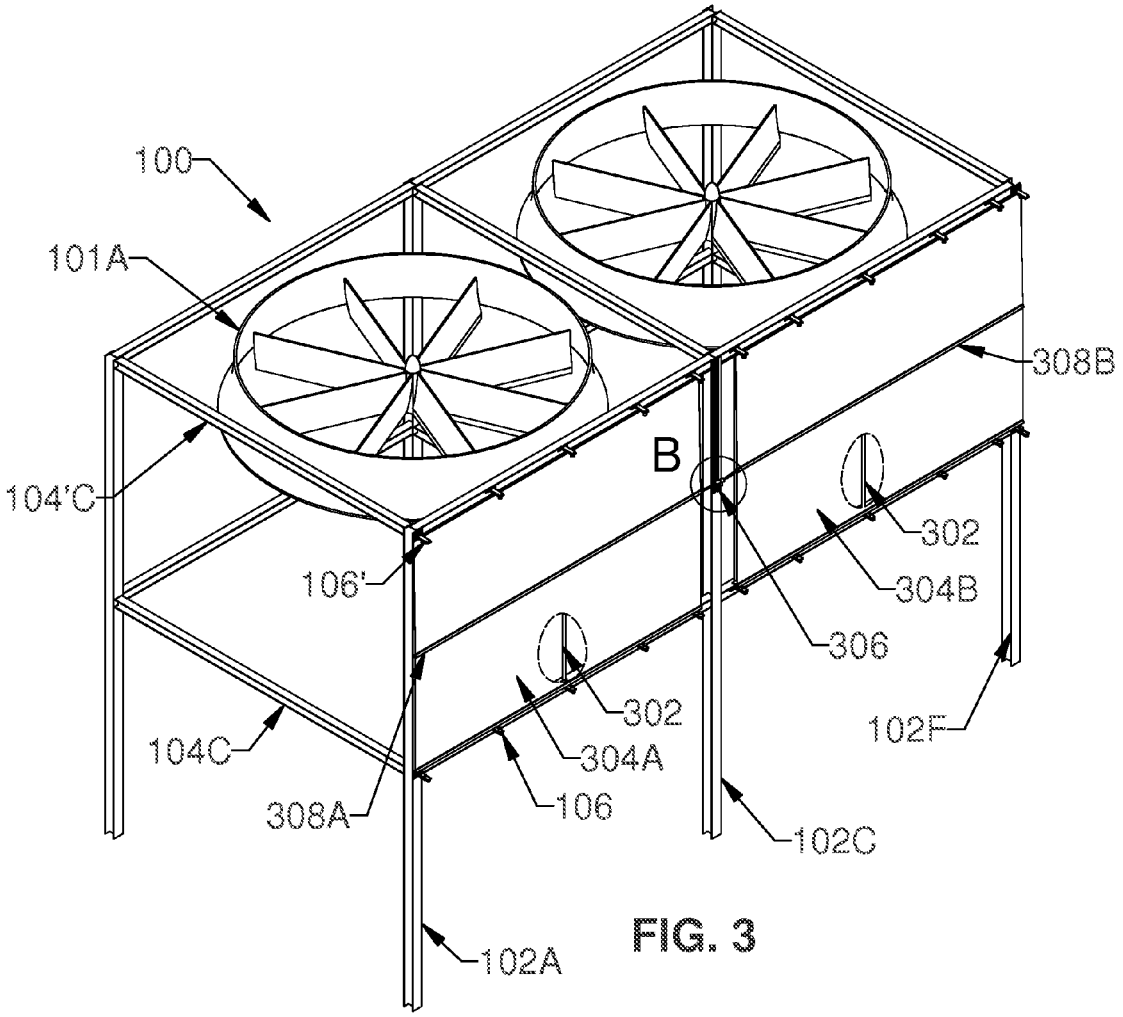

Turning to FIG. 3, further components of the shield system are shown having been installed. A set of elongate members/poles 302 are fitted between upper and lower pairs of the inner mounts 204 of the fixing members 106, 106' and thus extend vertically between the lower 104A, 104B and upper 104'A, 104'B struts of the structure 100. A first sheet 304A extends between uprights 102A and 102C and an adjacent second sheet 304B extends between uprights 102C and 102F.

The flexible sheets may comprise a mesh or a solid sheet. The mesh may be between 5% and 50% permeable/open, e.g. around 6%, 13%, 25% or 45% permeable/open gauge materials, depending on the application. An examples of a suitable mesh materials is PVC coated polyester. The flexible sheet may be coated with, or formed of, a (preferably non-toxic) material that provides rot-proof qualities, tear resistance and/or UV stability.

Figure 4:
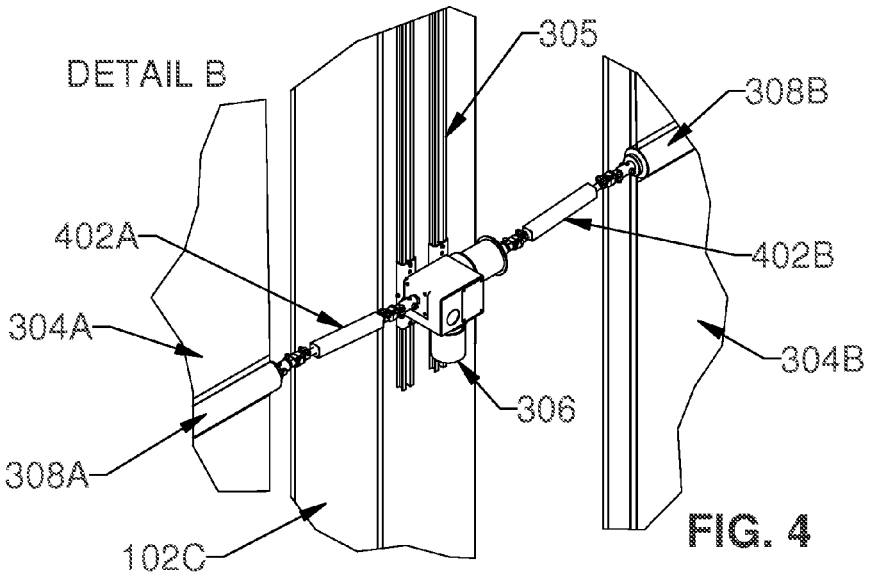

Attached to the middle upright 102C is a vertical track 305 onto which a climbing motor 306 is fitted. The climbing motor may be produced from components such as those sold by Lock Antriebstechnik GmbH of Ertingen, Germany. As detailed in FIG. 4, the motor 306 is attached to a first roller 308A that is connected to first sheet 304A as well as a second roller 308B that is connected to the second sheet 304B. The motor is connected to the two rollers by means of universal-type joints 402A, 402B. In alternative embodiments the motor may be installed on another part of the structure, e.g. on an end upright.

Figure 5:
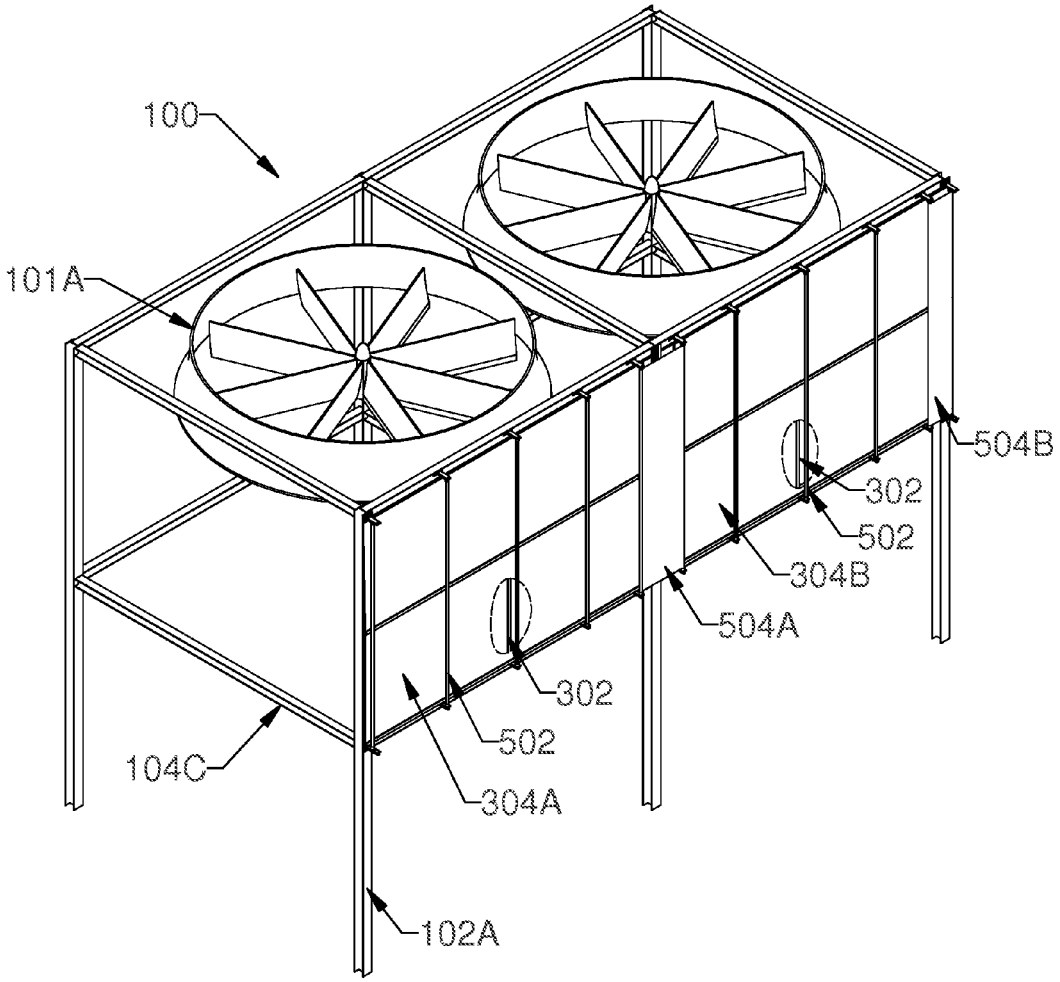
FIG. 5 shows the structure fitted with yet more components of the shield system.

FIG. 5 shows outer elongate members/poles 502 that are part of the shield system. These are fitted to the outer mounts 206 of the fixing members 106, 106' and thus extend vertically between the lower 104A, 104B and upper 104'A, 104'B struts of the structure 100. The sheets 304A, 304B are located between the inner poles 302 and the outer poles 502 and so the poles can limit movement of the sheets.

FIG. 5 also shows optional, additional covers of the shield system. These comprise sheets 504A, 504B that can be fitted to some of the fixing members 106, 106' and/or poles 302, 502. Typically, these additional covers will be located where there can be a gap between one of the sheets 304 and another sheet (or part of the side of the structure 100), or to protect the ends of sheets. In the example, cover 504A has been fitted outside over the motor/track on the middle upright and cover 504B has been fitted at the right-hand end of the side fitted with the shield system, although it will be understood that they can be fitted elsewhere, e.g. at both ends.

Figure 6:
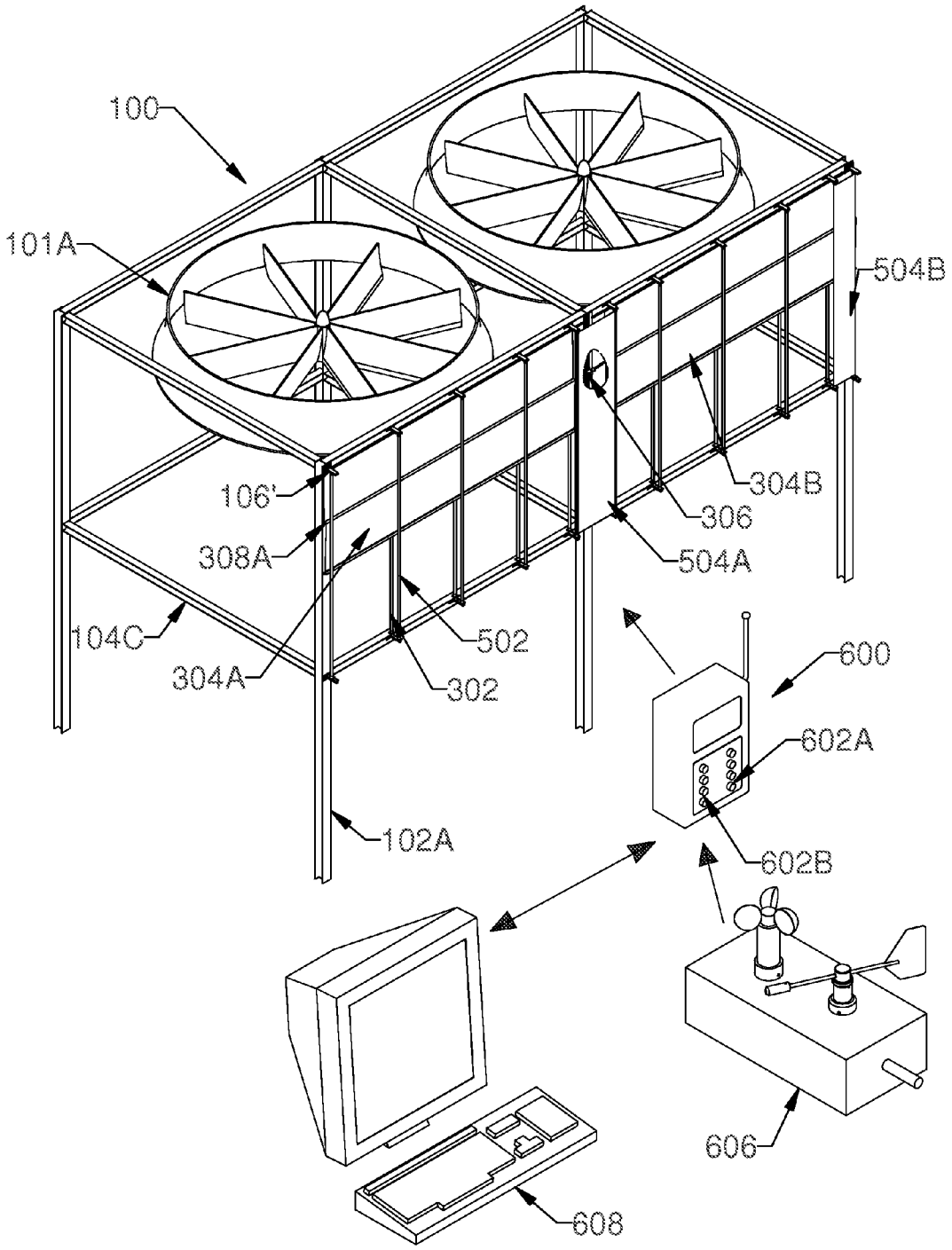
FIG. 6 shows the shield system in a partially open configuration.

As the motor 306 is driven by a controller, it moves up/down the track and winds the sheets 304A, 304B on/off the rollers 308A, 308B. FIG. 6 shows the sheets in a partially-open configuration, where they have been drawn up about halfway between lower 104 and upper struts 104'. The Figure also shows a schematic illustration of the controller 600, which may include manual controls 602A, 602B. The controller may send control signals to the motor by wired or wireless means. The controller can also communicate with a remote computer 608, e.g. for program updates, etc.

In some embodiments, the controller can be at least partially automated. For example, it may receive information or control signals from a remote weather monitoring device 606 via a communications interface 608 that determine the control signals transmitted to the motor 306. Alternatively, the monitoring and processing functionality may be built into the controller 600 itself. One of the weather conditions that may be monitored is wind speed. When the wind speed is relatively low, e.g. less than about 4.0 m/s, then the sheets may be left in a fully closed configuration. When the wind speed is in a medium range, e.g. around 4.1-6.0 m/s, then the sheets may be in a partially open configuration, and the extent of the opening may be directly proportional to the wind speed. When the wind speed is in a high range, e.g. over about 6.1 m/s, then the sheets may be fully open. It will be appreciated that the example ranges and actions described above are exemplary only and variations are possible. Having the shield "automatically" adjustable in this manner can increase its robustness and remove/reduce the need for reinforcing the AC structure when fitted with the shield.

Additionally or alternatively, the controller/processor may take into account factors (e.g. wind direction, air temperature, air pressure, precipitation, and/or various AC key performance indicators) other than wind speed when determining how to adjust the position of the sheets. Additionally, a frost protection measure can be included to prevent the wind shield system operating when there is a build-up of ice to reduce the risk of damage.

Figure 7:
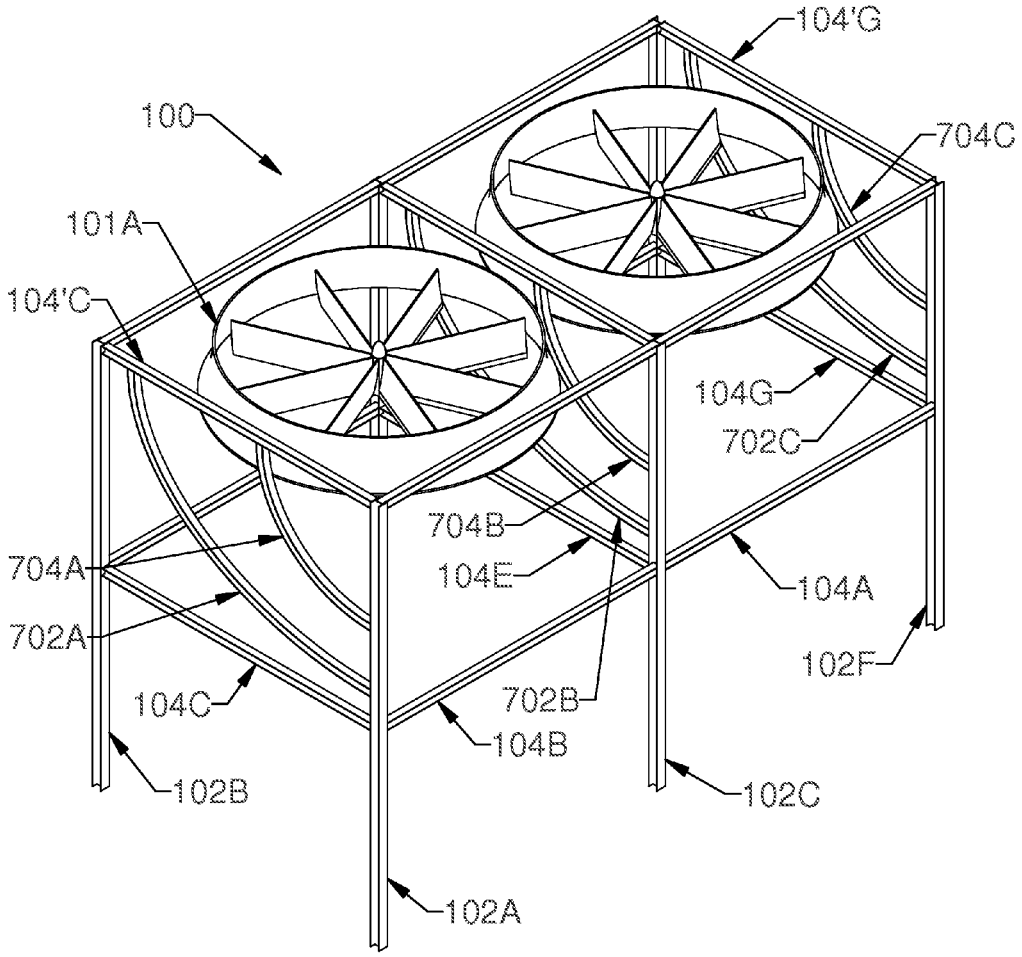
FIG. 7 shows the AC structure fitted with fixing members of another example shield system.

Turning to FIG. 7, an example of another shield system that may be installed instead of, or in addition to, the example described above is shown. The second embodiment of the shield comprises a fixing arrangement that includes a first curved member 702A that is connected to a lower surface of horizontal side upper strut 104'C and an inner surface of end upright 102A. One end of the member 702 is located about one sixth to one quarter of the distance between 104C and 104'C above the point where lower horizontal struts 104 connect to the upright 102A. Its other end is located about one sixth to one quarter of the distance between 102A and 102B from the point where the upper horizontal struts 104' meet upright 102B. There is a corresponding second curved member 702B having one end fixed to a corresponding location on the inner surface of middle upright 102C and its other end fixed to the lower surface of middle upper horizontal strut 104'E. There is also a third curved member 702B extending in a similar manner between end upright 102F and end upper horizontal upright 104'E.

The fixing arrangement further comprises a first short curved member 704A that is connected to a lower surface of the horizontal side upper strut 104'C and an inner surface of the end upright 102A. One end of the member 704A is located about halfway to three quarters of the distance between 104C and 104'C above the point where lower horizontal struts 104 connect to the upright 102A. Its other end is located about halfway to three quarters of the distance between 102A and 102B from the point where the upper horizontal struts 104' meet upright 102B. Again, there is a corresponding second short curved member 704B having one end fixed to a corresponding location on the inner surface of middle upright 102C and its other end fixed to the lower surface of middle upper horizontal strut 104'E. There is also a third curved short member 702B extending in a similar manner between end upright 102F and end upper horizontal upright 104'E.

The example curved members can be formed of any suitable material, e.g. steel, and it will be understood that their number, design and arrangement can be varied, e.g. they may be flat, angled sections rather than curved "H" beams. Additional bracing (not shown) can also be added if needed to withstand the expected loads.

FIG. 8 shows the shield system with a first lower sheet 802A fitted between curved members 702A and 702B. There is also a second lower sheet 802B fitted between curved members 702B and 702C. The system further includes a first upper sheet 804A fitted between curved members 704A and 704B, as well as a second upper sheet 804B between curved members 704B and 704C. The sheets may be fitted between the curved members by means of tensioning arrangements comprising straps 811 and clamps 813 as shown in FIG. 8A (and similar to the shields described in WO 2005/018745 in the name of GBR Industries Limited). Alternatively, as with the first embodiment described above, the system may include a motor for adjusting the position of the sheets, although this can also be done manually. In use, energy from wind blowing in the direction of the arrows can be diverted upwards to boost the performance of the fans of the AC. Thus, the system allows external wind power to be harnessed and used to benefit the AC rather than being detrimental to its performance. It will be appreciated that the shield systems described herein can be used with structures other than AC structures in some cases.

FIG. 8B shows a further example of a shield system that may be installed instead of, or in addition to, the first example described above. The third embodiment of the shield comprises a fixing arrangement that includes an upper angled elongate member 882A that is connected to an inner side surface of end upright 102A (adjacent its upper end) and a lower angled elongate member 884A (nearer where the upright is connected to the horizontal struts). One end of each of the angled members 882A, 884A protrudes into the inner space of the framework 100, whilst its other end depends at an angle outwardly.

There are corresponding upper and lower angled members 882B, 884B connected to the opposed side surface of central upright 102C. There are further upper and lower angled members 882C, 884C connected in a corresponding manner to the other side surface of central upright 102C, as well as further upper and lower members 882D. 884D connected to the opposed side surface of the other end upright 102F. The angled members may be connected in a rigid manner, e.g. by means of welds, to the framework, or may be connected in an adjustable manner, e.g. by means of pivot pins. Adjacent pairs of angled members, e.g. 882A,B; 884A,B and 882C,D; 884C,D may be set at the same or different angles.

Referring to FIGS. 8C and 8D, it can be seen that a first sheet 886A is connected between the opposed pair of upper angled members 882A and 882B. A second sheet 886B is connected between the corresponding lower angled members 884A and 884B. A third sheet 888A is connected between upper angled members 882C and 882D and a fourth sheet 888B is connected between lower angled members 884C and 884D. The sheets and sheet connection means may be the same as any of the examples given above. As shown by the arrows in FIGS. 8C and 8D, the sheets fitted between the angled members help direct external air towards the fans (in a similar manner to the second embodiment).

FIG. 9 illustrates an example of a catch mechanism 900 that can be used with some embodiments of the shield system, in particular where the sheet depends vertically as in the first embodiment described above. It will be understood that the catch can also be used in other applications, such as in agricultural buildings. Part of a roller, which may be attached to one of the sheets 304, for example, is shown at 902. The catch 900 includes a first member 904 that is connected by means of a pivot 906 to a second member 908. In use, the second member can be attached to a component (not shown), such as a roller shield frame, that is fixed in relation to the roller 902. In the example the roller is configured to move in an up/down direction.

The first member 904 comprises a substantially flat plate of steel or the like that has been shaped to include various portions. The second example member 908 also has a specific shape, but it will be understood that many variations to the designs and construction shown are possible.

Figure 10A:
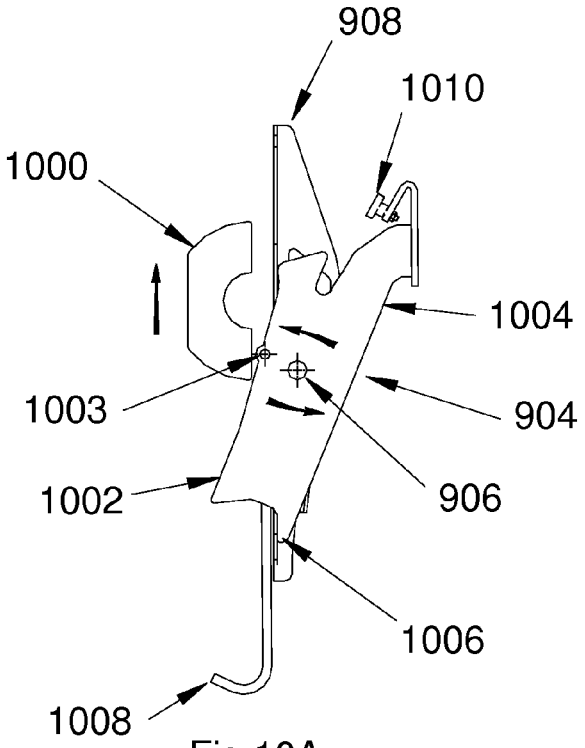

FIG. 10A shows a side view of the catch 900 where a part 1000 of the roller 902 is not engaged by the catch. It will be understood that the roller part is only one example of the type of movable device that can be fixed temporarily in position by the catch mechanism. When the part 1000 is being pulled downwards, as shown by the arrow, and the catch is in the configuration shown in FIG. 10A, a lower portion of the part 1000 strikes an angled portion 1002 of the first member 904. This causes the first member 904 to pivot relative to the second member 908, as illustrated by the curved arrows. The part 1000 can continue its downward movement, contacting the same surface of the first portion 1002 as it moves.

When the upper portion of the part 1000 has moved sufficiently downwards to break contact with the surface of the first portion 1002, the first portion can pivot back towards is previous configuration under the force of gravity. This is assisted by the presence of extending portion 1004 that includes a magnetic component (as described below). The part 1000 and the catch can then be in the configuration shown in FIG. 10B.

Figure 10B:
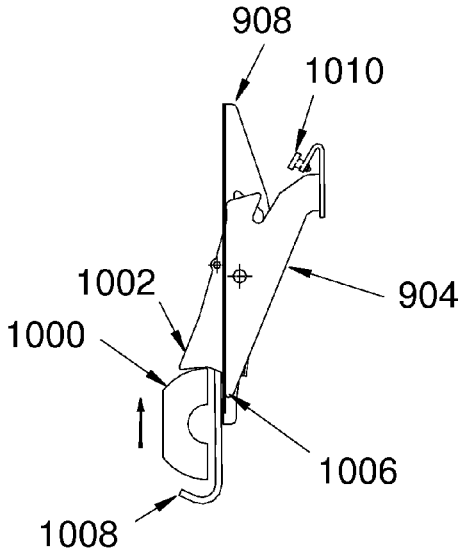

In FIG. 10B, a detent portion 1006 the partly forms an end of the portion 1002 abuts the upper surface of the part 1000. Thus, upwards direction of the part 1000 is prevented by its engagement with the first member, which is stopped from pivoting in a manner that will release the part 1000. In some cases, the part 1000 and roller will be subject to tension in the upwards direction due to conventional roller blind-type mechanisms or by winding the motor in a reverse direction, which will also assist with maintaining this engagement (as shown by the upwards arrow in the Figure).

Figure 10C:
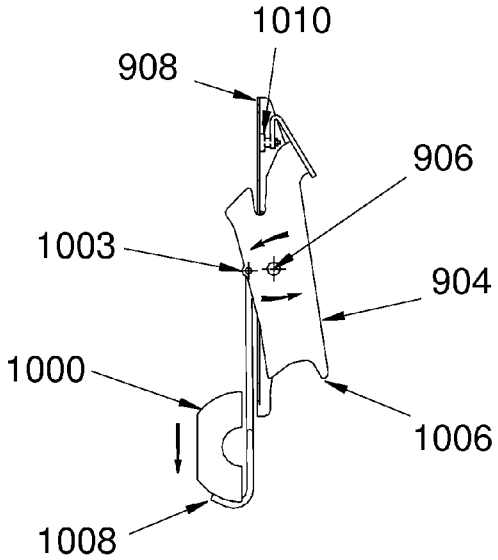

To disengage, a user pulls the part 1000 in a downwards direction, as illustrated in FIG. 10C. This causes the lower portion of the part 1000 to come into contact with a hook-shaped disengaging member 1008 that is pivotally connected to the first member 904 at point 1003. Continuing to pull the part 1000 downwards results in the first member pivoting as shown by the curved arrows. This brings a magnetic member 1010 that is mounted on the end of the extending portion 1004 into contact with an L-shaped portion of the metallic second member 908. The magnetic attraction keeps the first member fixed relative to the second member as shown in the Figure, with the edge of the first member that includes the first portion 1002 extending into the upwards path of the movable part 1000. It will be understood that a fixing mechanism other than a magnetic one, e.g. a releasable friction-based catch, can be used.

Figure 10D:
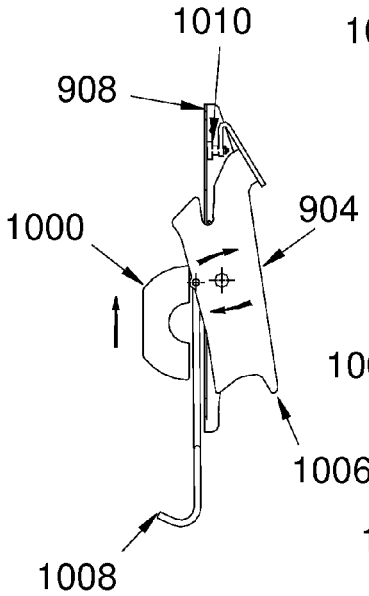
Figure 10E:
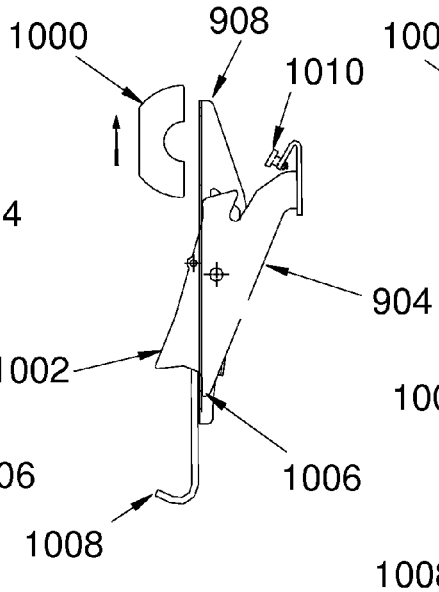

The disengagement of the part 1000 from detent portion 1006 allows the user to move/release the part 1000 in an upwards direction, as illustrated in FIG. 10D. When the upper portion of the part 1000 strikes the edge of the first member 904 that is in its path, this causes the first member to pivot as shown by the curved arrows. This pivoting motion breaks the magnetic contact between the device 1010 and the second member 908, as illustrated in FIG. 10E, and the part 1000 is free to move upwards, as also shown in that Figure. The first member 904 is now in a substantially similar configuration to that of FIG. 10A, which means that the engaging operation can be repeated as described above.

Figure 10F:
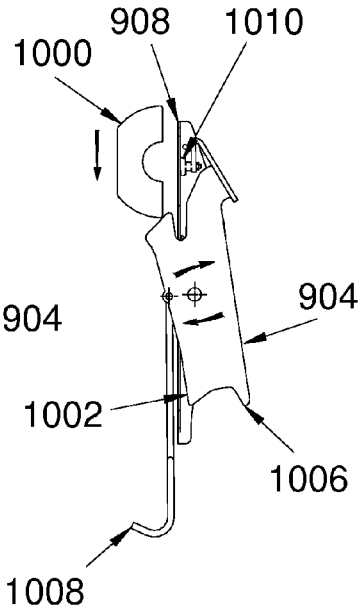

Referring to FIG. 10F, if the first member 904 happens to have been pivoted such that that magnetic engagement between device 1010 and the second member 908 is active whilst the part 1000 is located above the catch 900 then it is still possible for the catch to function correctly. In this case, the lower portion of the part 1000 will strike the angled edge of the first member leading from the surface including the first portion 1002. This causes the first member to pivot as illustrated by the curved arrows. Thus, the part 1000 can continue moving downwards and the pivoting also breaks the magnetic contact. The catch will then revert, under gravity, to the configuration shown in FIG. 10A, allowing it to engage with the part 1000 if that is drawn sufficiently downwards.

Figure 11A:
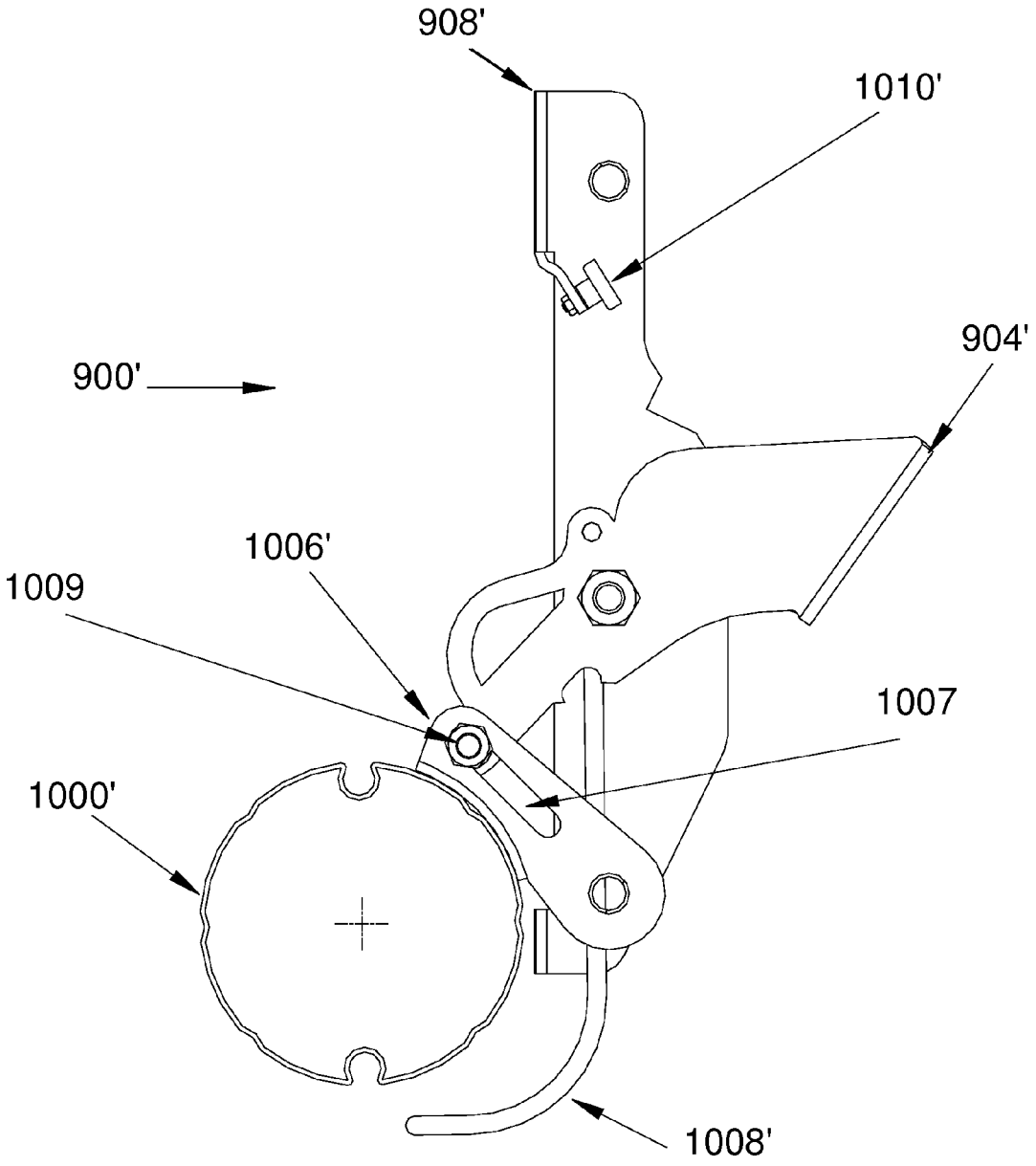
Figure 11B:
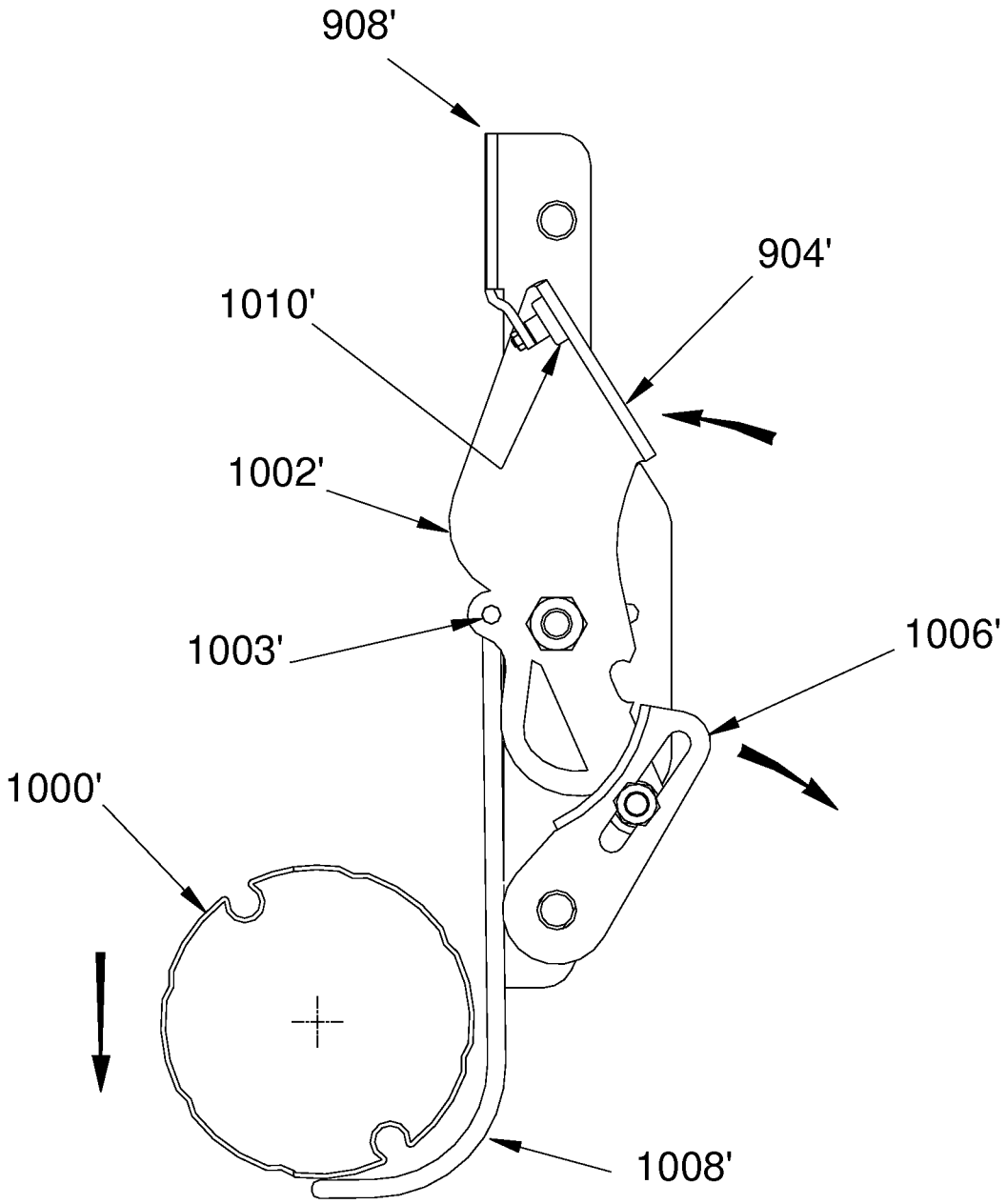
Figure 11C:
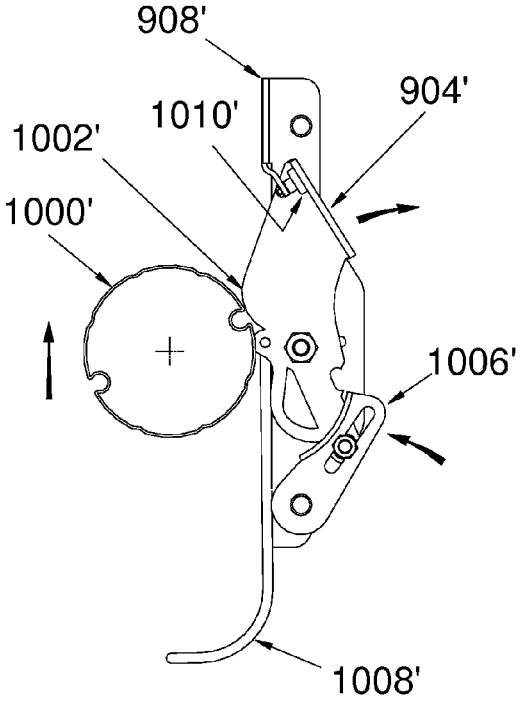
Figure 11D:
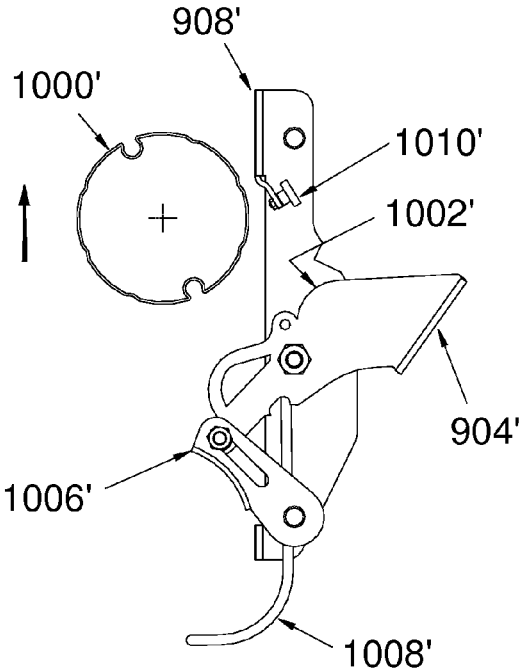

FIGS. 11A-11F illustrate a second example of a catch mechanism 900' that can be used with shield systems, including the examples described herein. FIG. 11A shows the catch locking a movable member 1000'. The member 1000' is prevented from moving upwards by an engaging component 1006' that includes a slot 1007 in which a pin 1009 is slidably engaged. The pin 1009 is fixed to part of a first member 904' that is pivotably connected to a fixed second member 908' (c.f. the configuration of the first embodiment shown in FIG. 10B). In order to disengage, the movable member 1000' is drawn downwards, as illustrated in FIG. 11B. This brings it into contact with disengaging member 1008', which is also drawn downwards. The remote end of member 1008' is connected by pin 1003' to the first member 904'. Thus, downward motion of member 1008' caused the first member 904' to pivot, moving component 1006' out of the upward path of the movable member 1000'. The pivoting action also causes the other end of the first member 904' to rotate as shown by the curved arrow, bringing it into contact with a temporary fixing device in the form of magnet 1010' that is connected to the second member 908'. As shown in FIG. 11C, the movable member 1000' is then free to move upwards. A portion 1002' of the first member 904' extends into the path of movement of the member 1000' and when these parts contact each other, the first member 904' pivots in the manner illustrated by the curved arrows. This breaks contact between magnet 1010' and the first portion 904, allowing the first portion to further pivot. This results in the portion 1002' and the component 1006 moving back into the downward path of movable member 1000', as shown in FIG. 11D.

Figure 11E:
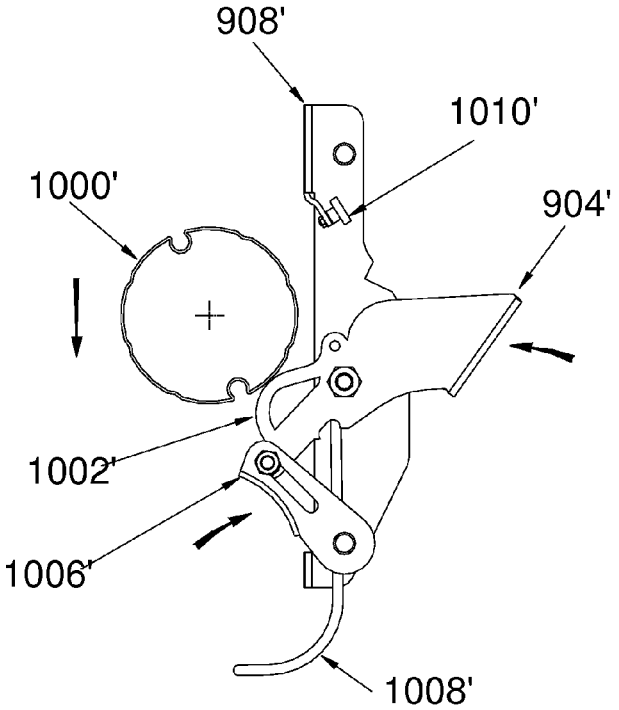

To re-engage, the movable member 1000' is moved downwards as shown in FIG. 11E. Its lower portion strikes the protruding portion 1002', causing the first member 904' and component 1006' to pivot as shown by the curved arrows. This allows the movable member to move downwards, but the rotation of first member 904' is not sufficient to bring the member into contact with the magnet 1010'. After this, the first member 904' rotates under gravity, brining component 1006' into contact with the upper portion of the movable member 1000', thereby locking it in place as shown in FIG. 11A.

Figure 11F:
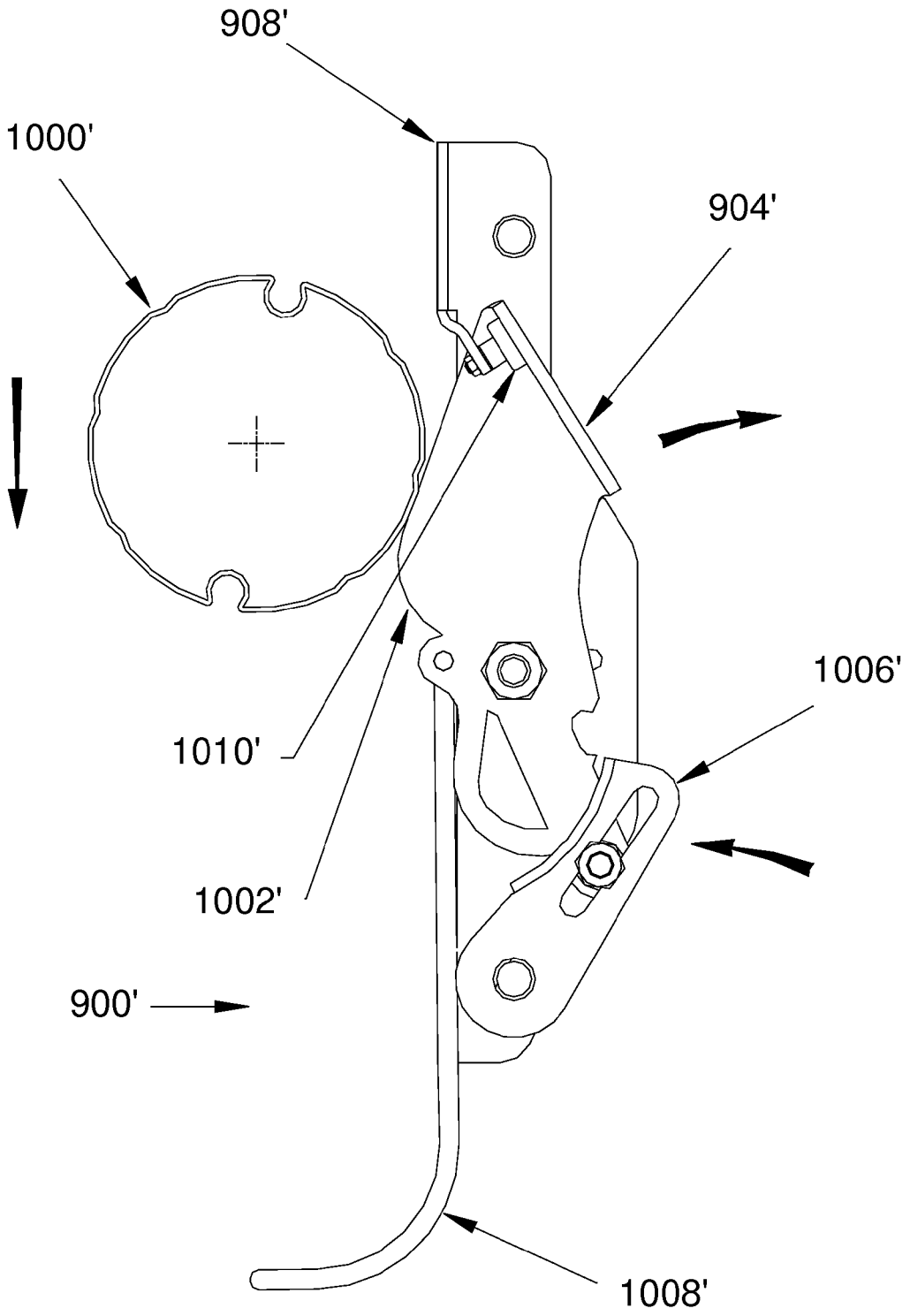

Referring to FIG. 11F, if the first member 904' has been rotated so that it has engaged the magnet 1010' whilst the movable member 1000' is above the catch, member 1000' can be moved downwards so that it strikes the protruding portion 1002' of the first member. This releases the magnet 1010' from the second member 908', allowing the first member 904' to rotate and reset the mechanism.

The catches described above are robust and easy to use, particularly for larger sheets/blinds, because a user can "automatically" engage/release it by simply moving part of the blind itself, rather than having to manipulate a separate mechanism.

The invention claimed is:

1. A shield system adapted for use in an air cooler structure (100), the shield system including:

at least one flexible sheet (304);

at least one fixing device (106) comprising pairs of fixing members attached at intervals to the air cooler structure;

a first fixing member of each pair of fixing members being disposed at an upper location of the air cooler structure and a second fixing member of each pair of fixing members being disposed at a lower location of the air cooler structure;

the system further comprising a plurality of first elongate members and a plurality of second elongate members which separately extend between the first and second fixing members;

wherein the at least one flexible sheet is positioned between the plurality of first elongate members and the plurality of second elongate members such that the plurality of first elongate members and the plurality of second elongate members limit substantial movement of the at least one flexible sheet in a direction which is substantially perpendicular to a plane of the at least one flexible sheet.

2. The system according to claim 1, further including a driving device (306) for adjusting a position of the at least one flexible sheet (304).

3. The system according to claim 2, wherein the driving device (306) is mounted on a part of the air cooler structure (100).

4. The system according to claim 3, wherein the driving device (306) travels along with a portion of the at least one flexible sheet (304) during sheet position adjustment in use.

5. The system according to claim 4, wherein the driving device (306) is connected to a third elongate member (308) running along at least part of a width of the at least one flexible sheet (304), in use, the driving device (306) winding the at least one flexible sheet (304) on or off of the third elongate member (308).

6. The system according to claim 2, wherein the driving device (306) is connected to, or includes, a controller (600) configured to receive control signals from a weather condition-monitoring device (606).

7. The system according to claim 6, wherein the weather condition-monitoring device (606) monitors wind speed and the controller (600) is configured to position the at least one flexible sheet (304) in a first configuration if the wind speed is within a first range and the controller is configured to position the at least one flexible sheet in a second configuration if the wind speed is within a second range.

8. The system according to claim 7, wherein the controller (600) is configured to position the at least one flexible sheet (304) in a fully open configuration if the wind speed is within the first range; the controller is configured to position the at least one flexible sheet in a partially-open configuration if the wind speed is within the second range, and the controller is configured to position the at least one flexible sheet in a fully-closed configuration if the wind speed is within a third range.

9. The system according to claim 7, wherein the weather condition-monitoring device (606) is adapted to monitor temperature, air pressure, wind direction, or precipitation and the controller (600) is configured to use at least one of these readings when determining how to position the at least one flexible sheet (304).

10. The system according to claim 1, wherein at least part (208) of each of the first and second members of each pair of fixing members (106) extends outwardly from the air cooler structure.

11. The system according to claim 1, wherein each of the first and second fixing members (106) of each pair of fixing members includes at least one mounting (206).

12. The system according to claim 1, wherein each of the first and second fixing members of each pair of fixing members includes a plurality of mountings including first (204) and second (206) mountings, one of the plurality of first elongate members (302) extending between a first set of upper and lower mountings the first and one of the plurality of second elongate members (502) extending between a second set of upper and lower mountings.

13. The system according to claim 1, wherein the at least one flexible sheet (304) includes first and second sheets, the first sheet extending between a first pair of vertical struts (102) of the air cooler structure (100) and the second sheet extending between a second pair of vertical struts (102) of the air cooler structure (100), and the system further including at least one cover sheet (504) extending between a gap between the first and second sheets (304).

14. The system according to claim 1, wherein the at least one flexible sheet (304) comprises a mesh of between around 5% and around 50% permeable or open gauge material.

15. The system according to claim 14, wherein the at least one flexible sheet is coated with, or formed of, a material that provides rot-proof qualities, tear resistance or UV stability.

16. The system according to claim 1, further including a catch mechanism for releaseably fixing a position of the at least one flexible sheet (304).

17. The system according to claim 16, wherein the catch mechanism (900) includes: a first member (904) pivotably connected to a second member (908), the first member including a first portion (1002) that, in a first configuration, extends into a path of a moveable device (1000) in use and is arranged such that when a lower part of the moveable device strikes the first portion when travelling in a first direction, the first member is pivoted to a second configuration where it is engageable with an upper part of the moveable device and prevents movement of the moveable device in an opposite direction until the catch mechanism is disengaged.

18. The system according to claim 17, wherein the mechanism further includes a disengaging member (1008) arranged so that if the moveable member (1000) is moved in the first direction after the catch mechanism has been engaged, the moveable member contacts the disengaging member, which moves the first member out of the second configuration such that the first portion is moved out of the path of the moveable device, thereby allowing the moveable device to be moved in the opposite direction.

19. The system according to claim 18, wherein the catch mechanism (900) further includes a fixing part (1010) arranged to temporarily fix the first member (904) with respect to the second member (908) until the upper portion of the moveable device (1000) has moved beyond a second portion of the first member after it has been moved out of the second configuration.

20. The system according to claim 19, wherein the fixing part (1010) includes a magnetic arrangement mounted on the first member (904) and configured to engage with a metal part of the second member (908).

21. The system according to claim 20, wherein the second portion (1006) of the first member (904) is arranged such that, when the fixing part (1010) is fixing the first member with respect of the second member (908), the moveable device moving in the opposite direction strikes the second portion and causes the fixing part to release the first member from the second member.

22. The system according to claim 21, wherein the first member is designed so that the first portion (904) moves to the first configuration following release of the fixing part (1010).

23. A shield system adapted for use in an air cooler structure, the shield system including:

at least one flexible sheet; and at least one fixing device comprising pairs of fixing members attached at intervals to the air cooler structure;

at least part of the pairs of fixing members extending outwardly from the air cooler structure;

a first fixing member of each pair of fixing members being disposed at an upper location of the air cooler structure and a second fixing member of each pair of fixing members being disposed at a lower location of the air cooler structure, each fixing member comprising a first and second mounting;

the system further comprising a plurality of first elongate members which separately extend between the first mountings of a vertically spaced pair of first and second fixing members, and a plurality of second elongate members which separately extend between the second mountings of the vertically spaced pair of first and second fixing members;

wherein at least part of each fixing member extends outwardly from the air cooler structure; and the at least one flexible sheet is positioned between the plurality of first elongate members and the plurality of second elongate members that the plurality of first elongate members and the plurality of second elongate members limit substantial movement of the at least one flexible sheet in a direction which is substantially perpendicular to a plane of the at least one flexible sheet.

24. An apparatus, comprising:

an air cooler structure; and a shield system for shielding the air cooler structure, the shield system comprising at least one flexible sheet and at least one fixing device comprising pairs of fixing members attached at intervals to the air cooler structure;

the pairs of fixing members including a first fixing member disposed at an upper location of the air cooler structure and a second fixing member disposed at a lower location of the air cooler structure, each fixing member comprising a first and second mounting;

the system further comprising a plurality of first elongate members which separately extend between the first mountings of a pair of first and second fixing members, and a plurality of second elongate members which separately extend between the second mountings of the pair of first and second fixing members;

wherein the at least one flexible sheet is positioned between the plurality of first and second elongate members such that the plurality of first elongate members and the plurality of second elongate members limit substantial movement of the at least one flexible sheet in a direction which is substantially perpendicular to a plane of the at least one flexible sheet.

* * * * *

UNITED STATES PATENT AND TRADEMARK OFFICE

CERTIFICATE OF CORRECTION

PATENT NO. : 8,997,828 B2
APPLICATION NO. : 13/379409
DATED : April 7, 2015
INVENTOR(S) : Melhuish et al.

It is certified that error appears in the above-identified patent and that said Letters Patent is hereby corrected as shown below:

Column 11, line 16, Claim 12 please delete "the first" after mountings.

Column 12, line 35, Claim 23 please insert -- such -- after members.

Signed and Sealed this
Twenty-sixth Day of January, 2016

Michelle K. Lee

Michelle K. Lee
*Director of the United States Patent and Trademark Office*